US009941076B2

(12) United States Patent
Chen

(10) Patent No.: US 9,941,076 B2
(45) Date of Patent: Apr. 10, 2018

(54) ILLUMINATED KEYBOARD DEVICE

(71) Applicant: Primax Electronics Ltd., Neihu, Taipei (TW)

(72) Inventor: Bo-An Chen, Taipei (TW)

(73) Assignee: Primax Electronics Ltd, Neihu, Taipai (TW)

( * ) Notice: Subject to any disclaimer, the term of this patent is extended or adjusted under 35 U.S.C. 154(b) by 73 days.

(21) Appl. No.: 14/693,459

(22) Filed: Apr. 22, 2015

(65) Prior Publication Data

US 2016/0284493 A1 Sep. 29, 2016

(30) Foreign Application Priority Data

Mar. 27, 2015 (TW) ..... 104109989 A

(51) Int. Cl.
*H01H 3/12* (2006.01)
*H01H 13/83* (2006.01)
*H01H 13/7065* (2006.01)

(52) U.S. Cl.
CPC ..... *H01H 13/83* (2013.01); *H01H 3/125* (2013.01); *H01H 13/7065* (2013.01); *H01H 2215/004* (2013.01); *H01H 2219/036* (2013.01); *H01H 2219/062* (2013.01); *H01H 2221/07* (2013.01)

(58) Field of Classification Search
CPC .. H01H 3/125; H01H 13/83; H01H 2219/036; H01H 2229/034
USPC ..... 200/5 A, 344, 310–314
See application file for complete search history.

(56) References Cited

U.S. PATENT DOCUMENTS

2005/0103610 A1* 5/2005 Hirahata ..... H01H 13/7006 200/310
2012/0048701 A1* 3/2012 Liu ..... H01H 3/125 200/5 A
2012/0080299 A1* 4/2012 Chen ..... H01H 13/83 200/5 A
2014/0034467 A1* 2/2014 Chou ..... H01H 3/125 200/5 A
2014/0138226 A1* 5/2014 Chen ..... H01H 13/704 200/5 A

* cited by examiner

*Primary Examiner* — Ahmed Saeed
(74) *Attorney, Agent, or Firm* — Evan R. Witt; Kirton McConkie

(57) ABSTRACT

An illuminated keyboard device includes plural keys, plural light-emitting elements and a membrane switch circuit module. Each key includes a keycap and an elastic element. Each elastic element has a protrusion. The plural elastic elements are located over plural contacts of the membrane switch circuit module and connected with the plural keycaps. The plural light-emitting elements are located under the corresponding elastic elements. Moreover, the protrusions within the elastic elements and the contacts of the membrane switch circuit module are all ring-shaped structures, and each light-emitting element is aligned with the center region of the corresponding contact of the membrane switch circuit module. Consequently, while the protrusion is moved downwardly to push the corresponding contact, a corresponding key signal is generated.

11 Claims, 12 Drawing Sheets

ILLUMINATED KEYBOARD DEVICE

FIELD OF THE INVENTION

The present invention relates to a keyboard device, and more particularly to a keyboard device with an illuminating function.

BACKGROUND OF THE INVENTION

A keyboard device is one of the widely-used computer peripheral devices. Via the keyboard device, the user may input characters or commands into a computer. With increasing development of science and technology, the keyboard device manufacturers make efforts in designing novel keyboard devices with diversified functions in order to meet the requirements of different users. Recently, an illuminated keyboard device with an illuminating function has been introduced into the market. Consequently, in case that the illuminated keyboard device is used in the dim environment with insufficient luminance, the characters marked on the keys of the illuminated keyboard device are still clearly visible to the user.

Hereinafter, the structure of a conventional illuminated keyboard device will be illustrated with reference to FIG. 1. FIG. 1 is a schematic cross-sectional view illustrating a conventional illuminated keyboard device.

Firstly, the components of the conventional illuminated keyboard device will be described. As shown in FIG. 1, the conventional illuminated keyboard device 1 comprises at least one key 11, a membrane switch circuit module 12, a supporting plate 13 and a backlight module 14.

The key 11 comprises a keycap 111, a scissors-type connecting element 112 and an elastic element 113. Moreover, the membrane switch circuit module 12 comprises an upper wiring plate 121 and a lower wiring plate 122. An upper contact 121*a* is formed on the upper wiring plate 121. Corresponding to the upper contact 121*a*, a lower contact 122*a* is formed on the lower wiring plate 122. Moreover, the backlight module 14 comprises a light guide plate 141, a reflective plate 142 and a light-emitting element 143.

The operating principle of the key 11 of the conventional illuminated keyboard device 1 will be illustrated in more details as follows. Firstly, the scissors-type connecting element 112 of the key 11 is connected with the keycap 111 and the supporting plate 13. The elastic element 113 is arranged between the keycap 111 and the supporting plate 13, and disposed within an accommodation space of the scissors-type connecting element 112. The membrane switch circuit module 12 is arranged between the elastic element 113 and the supporting plate 13.

As the key 11 is depressed, the keycap 111 is correspondingly moved with the scissors-type connecting element 112 in a vertical direction toward the supporting plate 13, and the membrane switch circuit module 12 is pushed by a protrusion part 113*a* within the elastic element 113. Under this circumstance, the upper contact 121*a* and the lower contact 122*a* of the membrane switch circuit module 12 are contacted with each other to be electrically conducted. Consequently, a corresponding input function is executed.

The illuminating principles of the conventional illuminated keyboard device 1 will be illustrated as follows. Firstly, the light guide plate 141 is located under the supporting plate 13, and the reflective plate 142 is located under the light guide plate 141. The light-emitting element 143 is located at a side of the light guide plate 141. The light-emitting element 143 may emit a light beam. The light beam is introduced into the light guide plate 141. Moreover, a portion of the light beam from the light-emitting element 143 is reflected by the reflective plate 142 so as to be projected upwardly toward the supporting plate 13 and transmitted through an opening 131 of the supporting plate 13. Moreover, the portion of the light beam is transmitted through a light-transmissible part of the keycap 111 so as to result in the illuminating efficacy.

However, the conventional illuminated keyboard device 1 still has the following drawbacks. Firstly, although the reflective plate 142 can facilitate the light beam to be reflected upwardly, a small portion of the light beam is transmitted through the reflective plate 142 because of the material of the reflective plate 142 of the conventional illuminated keyboard device 1. Since a portion of the light beam that is scattered downwardly is transmitted through the reflective plate 142, a portion of the light amount is lost. Secondly, although the light beam can be diffused into the whole light guide plate 141 after the light beam is introduced into the light guide plate 141, the light amount of the region farther from the light-emitting element 143 is less than the light amount of the region closer to the light-emitting element 143 because a portion of the light beam has been reflected out of the light guide plate 141 by the closer light-emitting element 143.

As mentioned above, the light utilization efficiency and the luminance uniformity of the conventional illuminated keyboard device 1 are not satisfied.

Therefore, there is a need of providing an improved illuminated keyboard device in order to overcome the above drawbacks.

SUMMARY OF THE INVENTION

An object of the present invention provides an illuminated keyboard device with enhanced light utilization efficiency and enhanced luminance uniformity.

In accordance with an aspect of the present invention, there is provided an illuminated keyboard device. The illuminated keyboard device includes plural keys, plural light-emitting elements and a membrane switch circuit module. The plural keys include plural keycaps and plural elastic elements, respectively. The elastic elements are located under the corresponding keycaps. Each of the plural keycaps includes at least one light outputting zone. The plural light-emitting elements are located under the corresponding elastic elements, and emit plural light beams to the corresponding light outputting zones. The membrane switch circuit module is located under the plural keys. The plural elastic elements are disposed on the membrane switch circuit module. The membrane switch circuit module includes an upper wiring plate, a lower wiring plate and a spacer layer. The upper wiring plate includes plural upper contacts. Each of the plural upper contacts is located under the corresponding elastic element. The lower wiring plate is located under the upper wiring plate, and includes plural lower contacts corresponding to the plural upper contacts. The spacer layer is arranged between the upper wiring plate and the lower wiring plate. The plural upper contacts and the plural lower contacts are separated from each other by the spacer layer. Each elastic element has a protrusion, and the protrusion is disposed within the elastic element and located over the corresponding upper contact. When one of the plural keycaps is depressed, the membrane switch circuit module is pressed by the protrusion, so that the corresponding upper contact and the corresponding lower contact are contacted with each other to generate a corresponding key signal.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
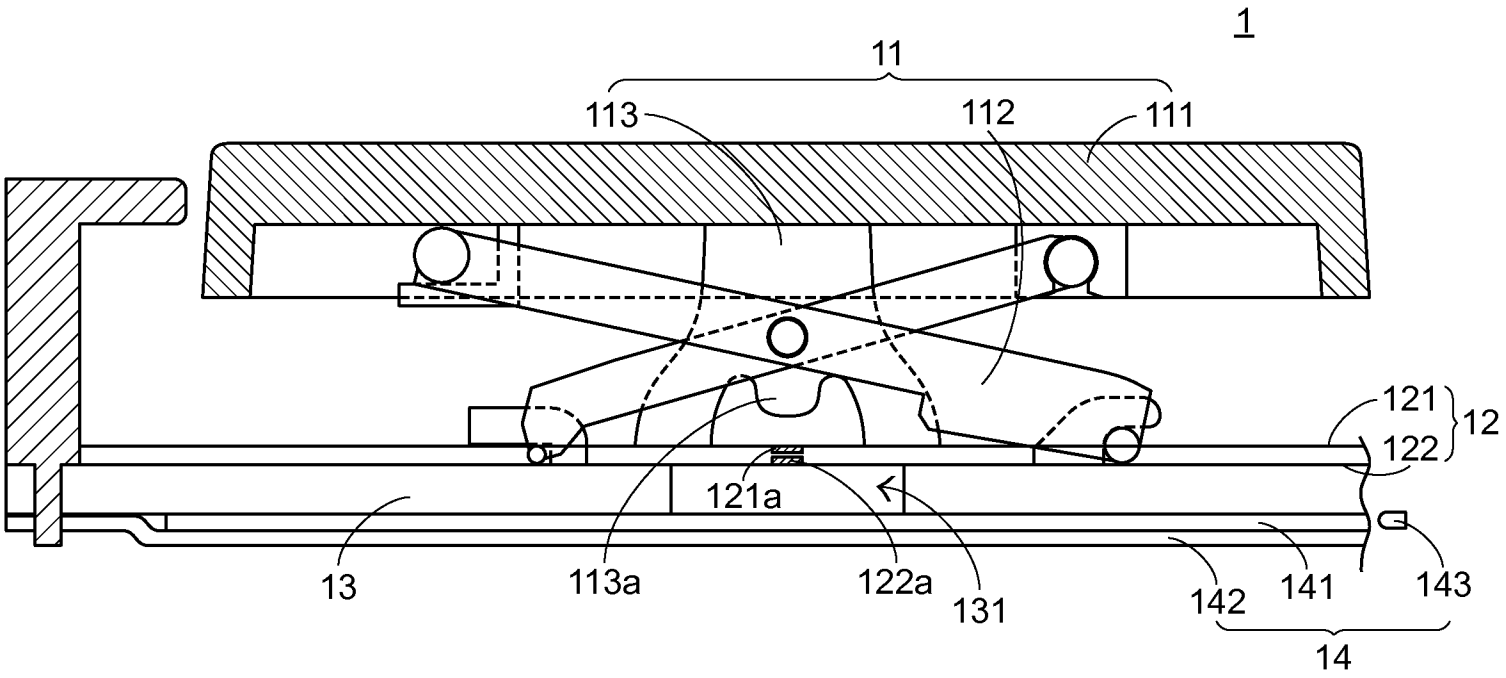
FIG.1 PRIOR ART
FIG. 1 is a schematic cross-sectional view illustrating a conventional illuminated keyboard device.
Figure 2:
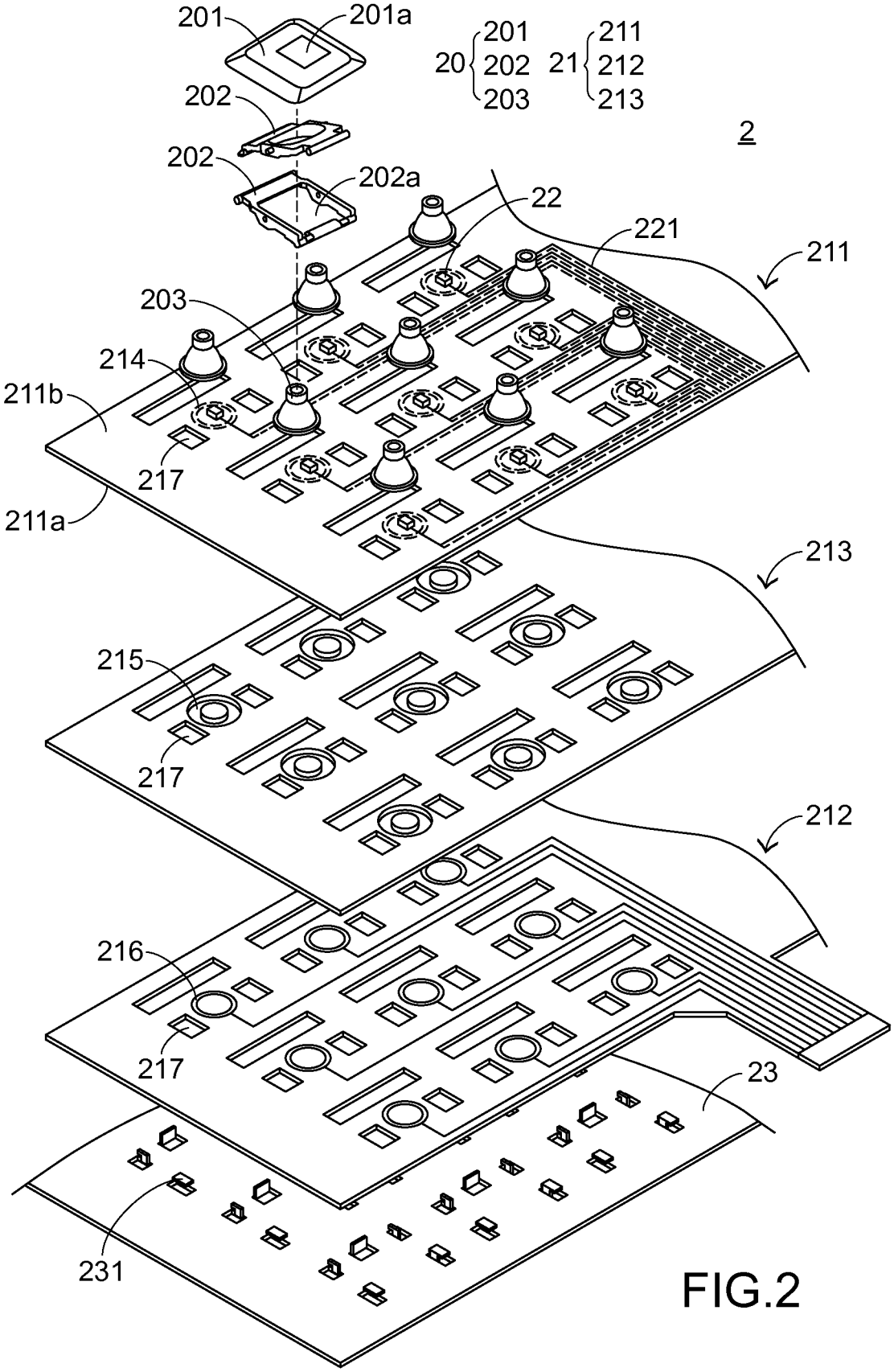
FIG. 2 is a schematic exploded view illustrating the illuminated keyboard device according to a first embodiment of the present invention.
Figure 3:
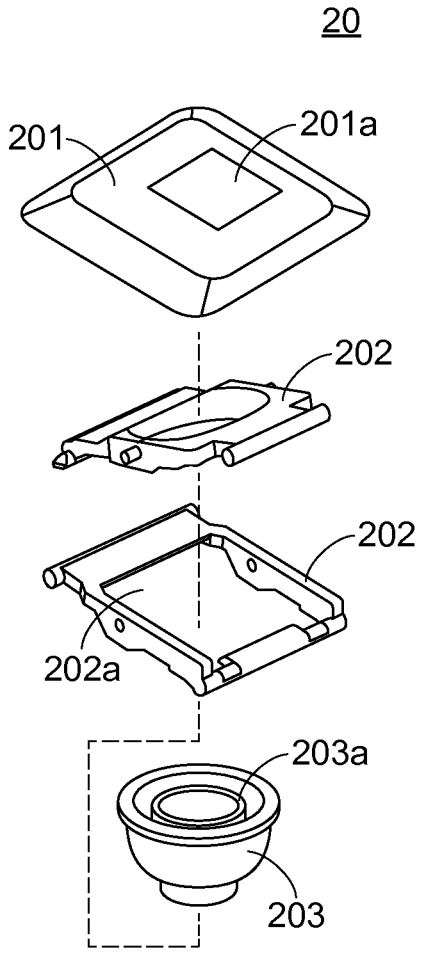
FIG. 3 is a schematic exploded view illustrating a key of the illuminated keyboard device according to the first embodiment of the present invention.
Figure 4:
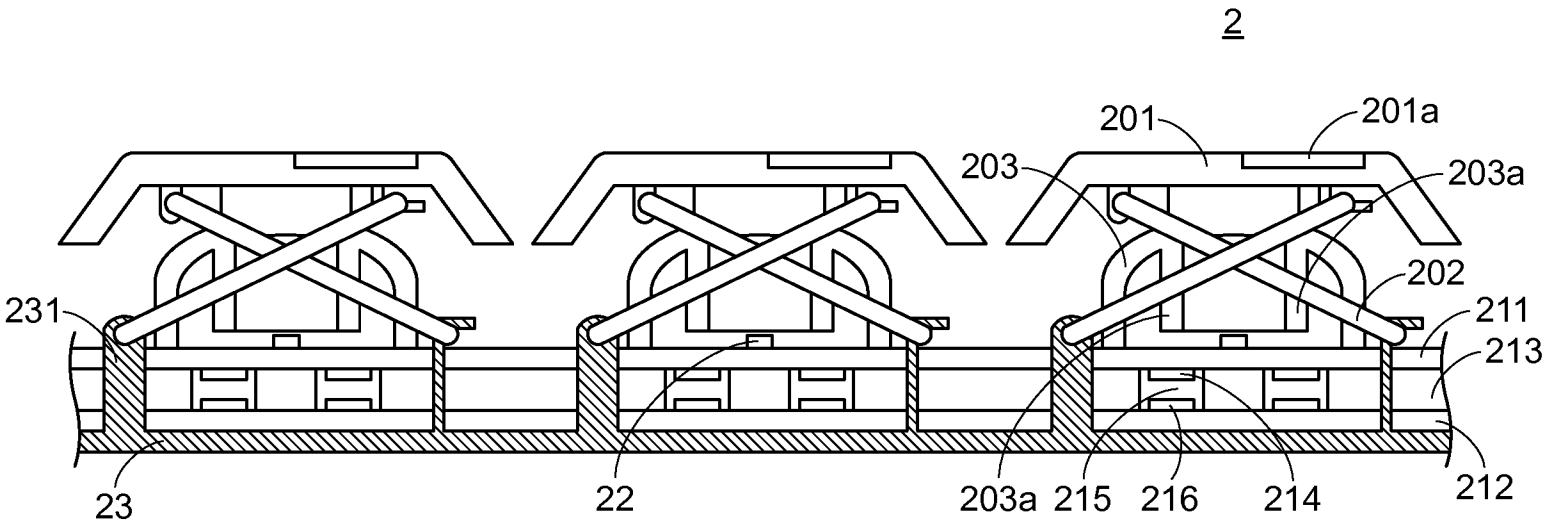
FIG. 4 is a schematic cross-sectional view illustrating the illuminated keyboard device according to the first embodiment of the present invention.

The present invention provides an illuminated keyboard device. Some examples of the illuminated keyboard device of the present invention will be illustrated as follows in more details. Hereinafter, an illuminated keyboard device according to a first embodiment of the present invention will be illustrated with reference to FIGS. 2, 3 and 4. FIG. 2 is a schematic exploded view illustrating the illuminated keyboard device according to the first embodiment of the present invention. FIG. 3 is a schematic exploded view illustrating a key of the illuminated keyboard device according to the first embodiment of the present invention. FIG. 4 is a schematic cross-sectional view illustrating the illuminated keyboard device according to the first embodiment of the present invention.

Firstly, the components of the illuminated keyboard device 2 will be illustrated as follows. The illuminated keyboard device 2 comprises plural keys 20, a membrane switch circuit module 21, plural light-emitting elements 22 and a supporting plate 23. For clarification and brevity, only one key 20 is shown in FIG. 2.

Each key 20 comprises a keycap 201, a scissors-type connecting element 202 and an elastic element 203. In FIGS. 2 and 3, the structures of the elastic element 203 are taken from different viewpoints. For clearly understanding the inner structures of the elastic element 203, the elastic element 203 of FIG. 3 is turned upside down. The membrane switch circuit module 21 comprises an upper wiring plate 211, a lower wiring plate 212 and a spacer layer 213. Moreover, plural upper contacts 214 are disposed on a bottom surface 211*a* of the upper wiring plate 211 and connected with each other. In FIG. 2, the plural upper contacts 214 are indicated by dotted lines. The spacer layer 213 is located under the upper wiring plate 211 and comprises plural perforations 215. The lower wiring plate 212 is located under the spacer layer 213 and comprises plural lower contacts 216. The plural lower contacts 216 are connected with each other. Each upper contact 214 is aligned with a corresponding perforation 215 and a corresponding lower contact 216. The upper contact 214, the corresponding perforation 215 and the corresponding lower contact 216 are collectively defined as a key switch for generating a key signal. In this embodiment, all of the upper contacts 214, the perforations 215 and the lower contacts 216 are ring-shaped structures. It is noted that the ring-shaped structures are not restricted to circular ring-shaped structures. The ring-shaped structures as shown in the drawings are presented herein for purpose of illustration and description only.

The sequence of assembling the illuminated keyboard device 2 will be illustrated as follows. Firstly, as shown in FIGS. 2 and 4, the plural light-emitting elements 22 are disposed on the membrane switch circuit module 21, and the membrane switch circuit module 21 is arranged between the plural keys 20 and the supporting plate 23. In particular, the plural light-emitting elements 22 are disposed on a top surface 211*b* of the upper wiring plate 211 and located under the corresponding keycaps 201. Moreover, plural light source wiring lines 221 are formed on the top surface 211*b* of the upper wiring plate 211. In FIG. 2, the plural light source wiring lines 221 are indicated by solid lines. The plural light-emitting elements 22 are connected with each other through the plural light source wiring lines 221. Each of the plural light-emitting elements 22 emits a light beam. The light beam is projected upwardly to the corresponding keycap 201. Consequently, the light beam is outputted from a light outputting zone 201*a* of the keycap 201 so as to result in the illuminating efficacy. In this embodiment, each of the plural light-emitting elements 22 is aligned with a center region of the corresponding upper contact 214. In particular, each light-emitting element 22 is located over the center region of the corresponding upper contact 214.

The plural elastic elements 203 are disposed on the top surface 211*b* of the upper wiring plate 211 and connected with the corresponding keycaps 201. The upper contacts 214 and the light-emitting elements 22 are located under the corresponding elastic elements 203. Moreover, a protrusion 203*a* is disposed within the elastic element 203. The protrusion 203*a* is disposed over the corresponding upper contact 214. In this embodiment, as shown in FIG. 3, the protrusion 203*a* and the upper contact 214 are corresponding ring-shaped structures. In an embodiment, the plural elastic elements 203 are separate components that are individually adhered on the upper wiring plate 211. Alternatively, in another embodiment, the plural elastic elements 203 are connected with each other. Moreover, since the elastic elements 203 are made of light-transmissible material, the light beams emitted by the light-emitting elements 22 are transmissible through the elastic elements 203.

The plural scissors-type connecting elements 202 are disposed on the top surface 211*b* of the upper wiring plate 211 and connected with the corresponding keycaps 201. Each elastic element 203 is disposed within an accommodation space 202*a* of the corresponding scissors-type connecting element 202.

Moreover, the supporting plate 23 comprises plural supporting bulges 231. The plural supporting bulges 231 are respectively penetrated through plural openings 217 of the membrane switch circuit module 21 and exposed to the top surface 211*b* of the upper wiring plate 211. Moreover, the plural supporting bulges 231 are connected with the corresponding scissors-type connecting elements 202. Consequently, the plural scissors-type connecting elements 202 are fixed over the membrane switch circuit module 21. As shown in FIG. 2, each scissors-type connecting element 202 is connected with five supporting bulges 231. It is noted that the number of the supporting bulges 231 is not restricted. That is, the number of the supporting bulges 231 corresponding to each scissors-type connecting element 202 may be altered according to the practical requirements.

After the above assembling procedures are completed, the illuminated keyboard device 2 of the present invention is fabricated. When one of the keycaps 201 is depressed, the depressed keycap 201 is stably moved downwardly to compress the corresponding elastic element 203 through the corresponding scissors-type connecting element 202. Consequently, the protrusion 203*a* within the elastic element 203 is moved downwardly to push the upper wiring plate 211. Under this circumstance, the upper contact 214 of the upper wiring plate 211 under the protrusion 203*a* is inserted into the corresponding perforation 215 of the spacer layer 213, and contacted with the lower contact 216 of the lower wiring plate 212. Consequently, a corresponding key signal is generated. When the keycap 201 is no longer depressed, the elastic element 203 provides an elastic force to the keycap 201. In response to the elastic force and with the assistance of the scissors-type connecting element 202, the keycap 201 is stably moved upwardly to the original position where the keycap 201 is not depressed.

As previously described, the light utilization efficiency and the luminance uniformity of the conventional illuminated keyboard device 1 are not satisfied. For increasing the light utilization efficiency and the luminance uniformity of the conventional illuminated keyboard device 1, the light-emitting element may be directly located under the key 11 to provide the light beam to the key 11. However, if the light-emitting element is located under the elastic element 113 of the conventional illuminated keyboard device 1, the compressible extent of the elastic element 113 is restricted by the light-emitting element. Since the compressible extent of the elastic element 113 is insufficient, the action of depressing the keycap 111 fails to result in the electrical conduction between the corresponding upper contact 121*a* and the corresponding lower contact 122*a* of the membrane switch circuit module 12. On the other hand, if the light-emitting element is located under the membrane switch circuit module 12 of the conventional illuminated keyboard device 1, the light beam projected upwardly to the keycap 111 is obstructed by the upper contact 121*a* and the corresponding lower contact 122*a*. In other words, the arrangement of the light-emitting element under the key 11 to directly provide the light beam to the key 11 cannot be effectively applied to the conventional illuminated keyboard device 1.

In accordance with the illuminated keyboard device 2 of the present invention, the protrusion 203*a* within the elastic element 203 and the upper contact 214 and the lower contact 216 of the membrane switch circuit module 21 are ring-shaped structures, and the light-emitting element 22 is aligned with the center region of the corresponding upper contact 214 of the membrane switch circuit module 21. Consequently, while the keycap 201 is moved downwardly to compress the elastic element 203, the protrusion 203*a* can be smoothly moved downwardly to push the membrane switch circuit module 21 without being obstructed by the light-emitting element 22. Under this circumstance, the upper contact 214 of the upper wiring plate 211 and the lower contact 216 of the lower wiring plate 212 are contacted with each other to generate the key signal. Moreover, the light beam from the light-emitting element 22 can be projected to the keycap 201 without being obstructed by the upper contact 214 and the lower contact 216. As mentioned above, the arrangement of the light-emitting element under the key to directly provide the light beam to the key cannot be effectively applied to the conventional illuminated keyboard device. Obviously, the illuminated keyboard device 2 of the present invention can overcome these drawbacks.

Moreover, in this embodiment, the plural light-emitting elements 22 are disposed on the top surface 211*b* of the upper wiring plate 211, and the upper wiring plate 211 is located at the topmost layer of the membrane switch circuit module 21. Consequently, the plural light-emitting elements 22 are very close to the plural keycaps 201 to provide the illuminating efficacy with enhanced light utilization efficiency and enhanced luminance uniformity.

Some variant examples of the illuminated keyboard device of the present invention will be illustrated in the following embodiments from a second embodiment to an eighth embodiment.

Figure 5:
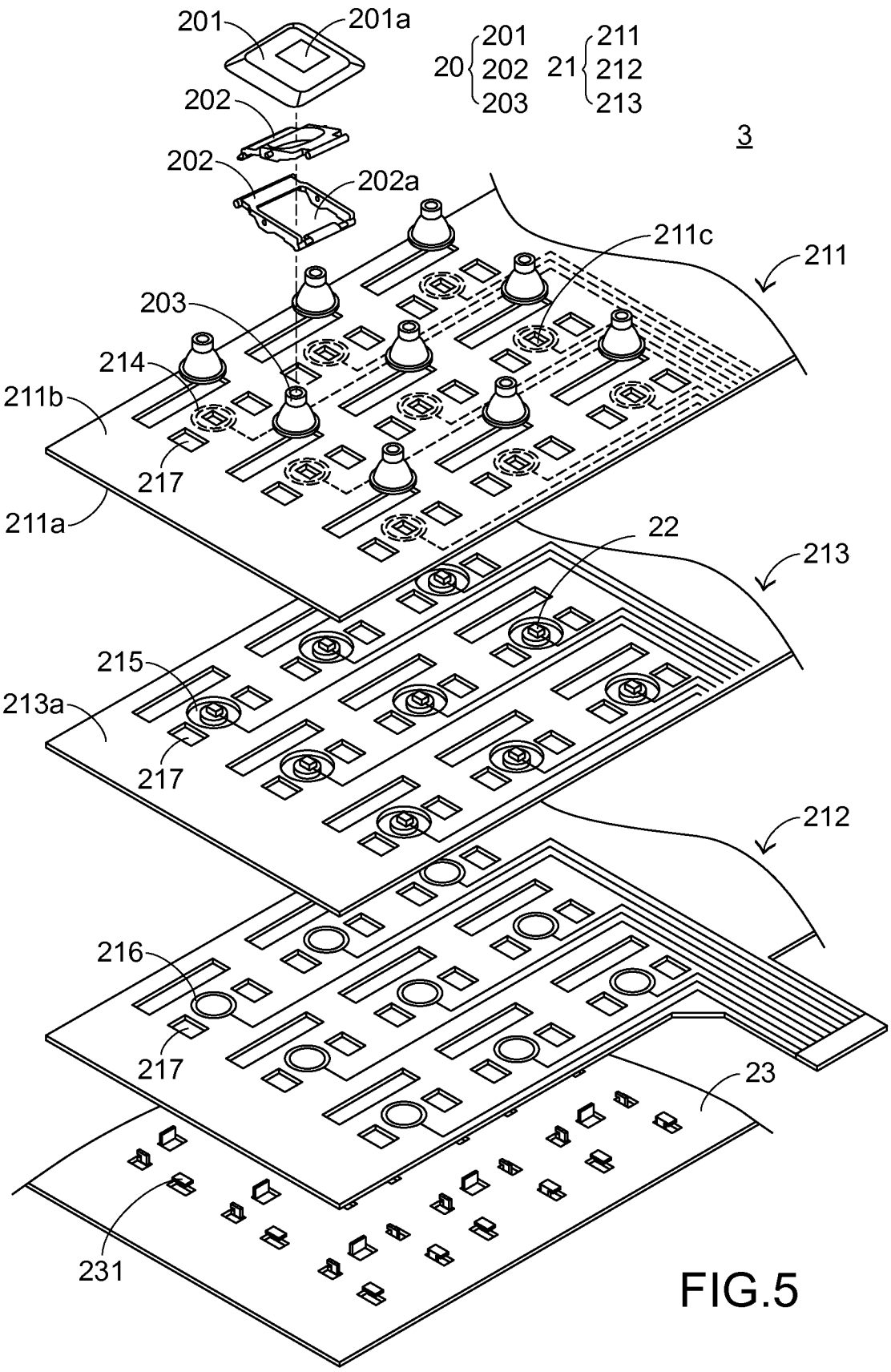
FIG. 5 is a schematic exploded view illustrating the illuminated keyboard device according to a second embodiment of the present invention.
Figure 6:
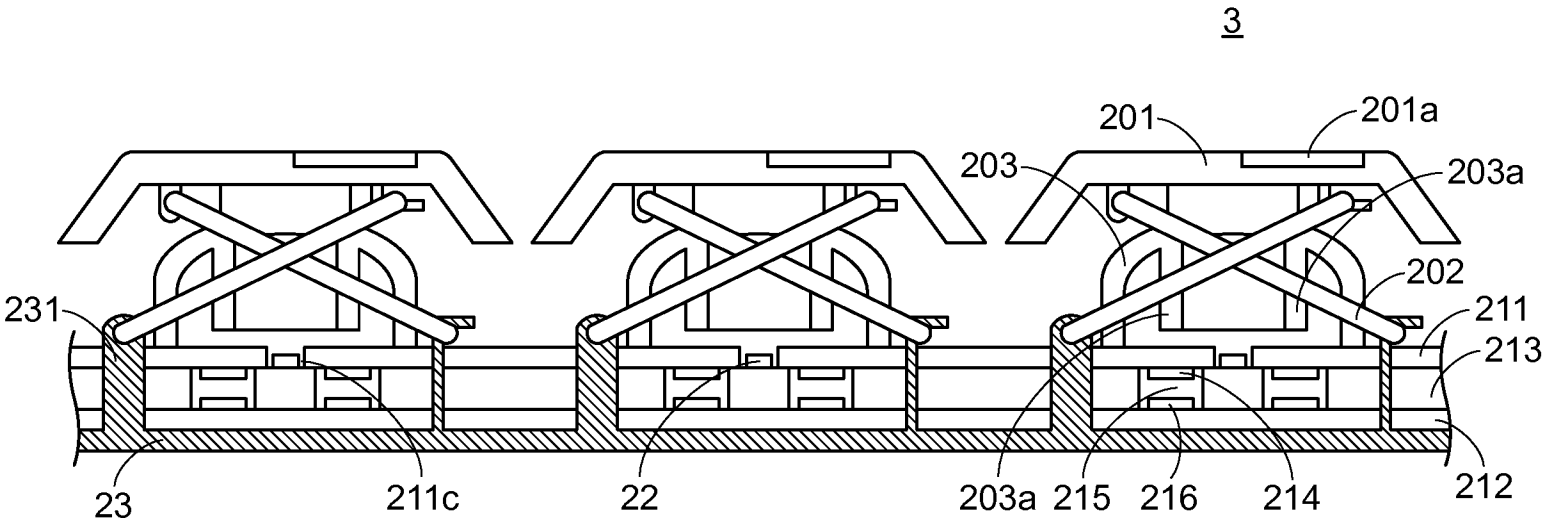
FIG. 6 is a schematic cross-sectional view illustrating the illuminated keyboard device according to the second embodiment of the present invention.

Hereinafter, an illuminated keyboard device 3 according to a second embodiment of the present invention will be illustrated with reference to FIGS. 5 and 6. FIG. 5 is a schematic exploded view illustrating the illuminated keyboard device according to the second embodiment of the present invention. FIG. 6 is a schematic cross-sectional view illustrating the illuminated keyboard device according to the second embodiment of the present invention.

In comparison with the first embodiment, the plural light-emitting elements 22 of the illuminated keyboard device 3 in this embodiment are disposed on a top surface 213*a* of the spacer layer 213. In particular, the upper wiring plate 211 has plural openings 211*c*. Each of the plural openings 211*c* runs through a center region of the corresponding upper contact 214 of the upper wiring plate 211. The plural light-emitting elements 22 are inserted into the corresponding openings 211*c* and exposed to the underlying regions of the corresponding elastic elements 203. The plural light source wiring lines 221 are formed on the top surface 213*a* of the spacer layer 213. The plural light-emitting elements 22 are connected with each other through the plural light source wiring lines 221.

As mentioned above, the arrangement of the light-emitting element under the key to directly provide the light beam to the key cannot be effectively applied to the conventional illuminated keyboard device. Obviously, the illuminated keyboard device 3 of the present invention can overcome these drawbacks. In other words, the light utilization efficiency and the luminance uniformity of the illuminated keyboard device 3 are both enhanced.

The structure and operating principle of the illuminated keyboard device 3 of this embodiment are similar to those of the illuminated keyboard device 2 of the first embodiment, and are not redundantly described herein.

Figure 7:
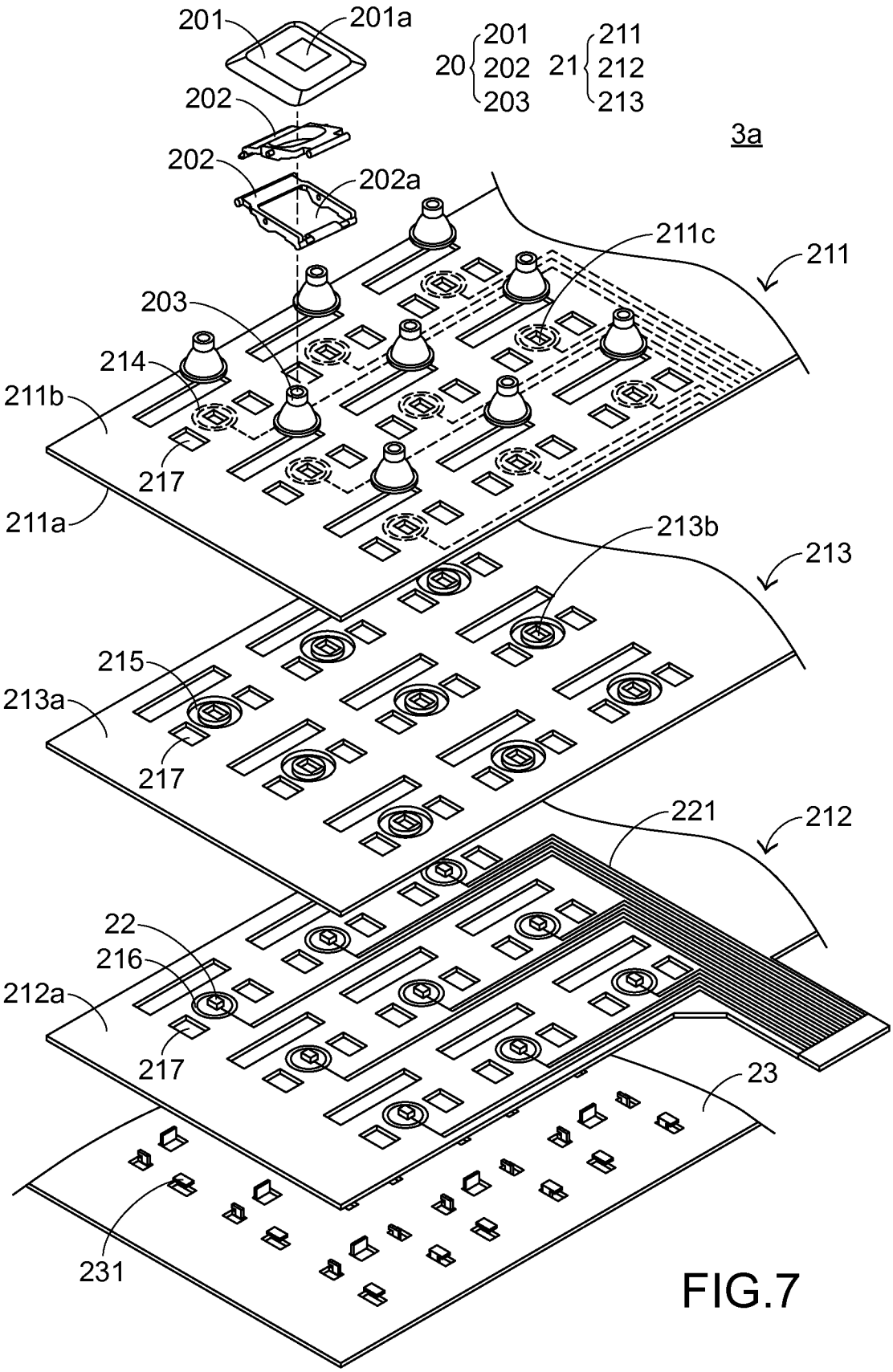
FIG. 7 is a schematic exploded view illustrating the illuminated keyboard device according to a third embodiment of the present invention.
Figure 8:
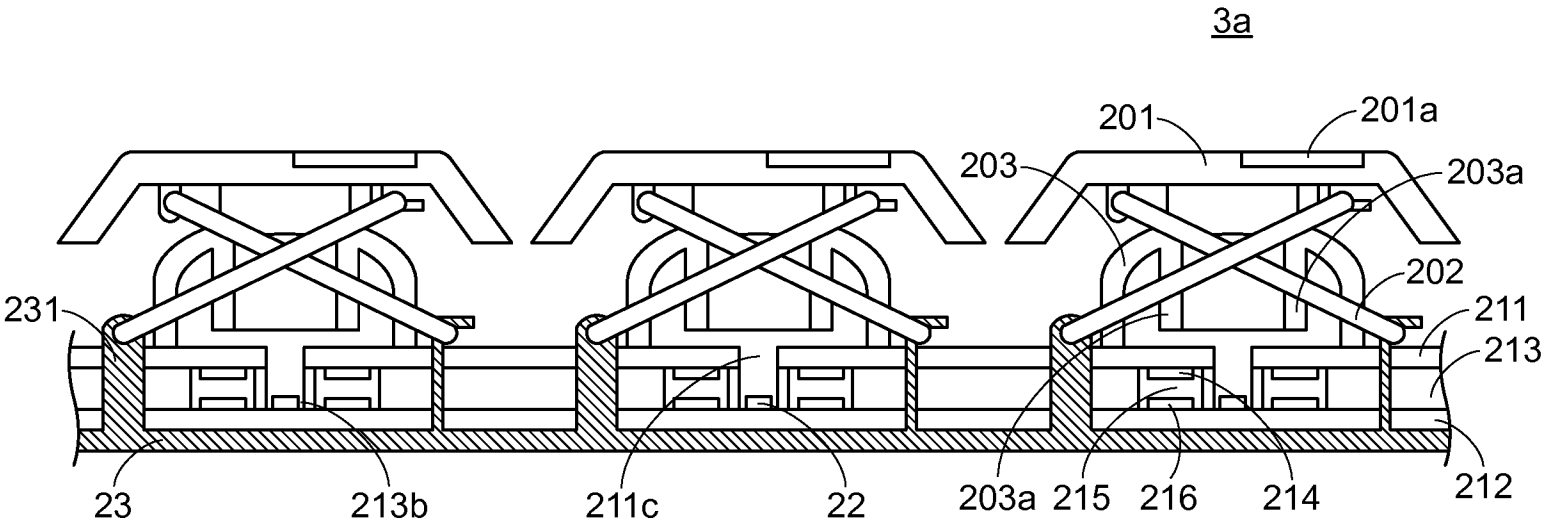
FIG. 8 is a schematic cross-sectional view illustrating the illuminated keyboard device according to the third embodiment of the present invention.

Hereinafter, an illuminated keyboard device 3*a* according to a third embodiment of the present invention will be illustrated with reference to FIGS. 7 and 8. FIG. 7 is a schematic exploded view illustrating the illuminated keyboard device according to the third embodiment of the present invention. FIG. 8 is a schematic cross-sectional view illustrating the illuminated keyboard device according to the third embodiment of the present invention.

In comparison with the first embodiment, the plural light-emitting elements 22 of the illuminated keyboard device 3*a* in this embodiment are disposed on a top surface 212*a* of the lower wiring plate 212. In particular, the upper wiring plate 211 has plural openings 211*c*, and the spacer layer 213 has plural openings 213*b* in communication with the plural openings 211*c*. Each of the plural openings 211*c* runs through a center region of the corresponding upper contact 214 of the upper wiring plate 211. The plural light-emitting elements 22 are inserted into the corresponding openings 213*b* and exposed to the underlying regions of the corresponding elastic elements 203. The plural light source wiring lines 221 are formed on the top surface 212*a* of the lower wiring plate 212. The plural light-emitting elements 22 are connected with each other through the plural light source wiring lines 221. Moreover, the light beams from the plural light-emitting elements 22 are transmitted through the plural openings 213*b* of the spacer layer 213 and the plural openings 211*c* of the upper wiring plate 211 and projected to the corresponding keycaps 201.

As mentioned above, the arrangement of the light-emitting element under the key to directly provide the light beam to the key cannot be effectively applied to the conventional illuminated keyboard device. Obviously, the illuminated keyboard device 3*a* of the present invention can overcome these drawbacks. In other words, the light utilization efficiency and the luminance uniformity of the illuminated keyboard device 3*a* are both enhanced.

The structure and operating principle of the illuminated keyboard device 3*a* of this embodiment are similar to those of the illuminated keyboard device 2 of the first embodiment, and are not redundantly described herein.

Figure 9:
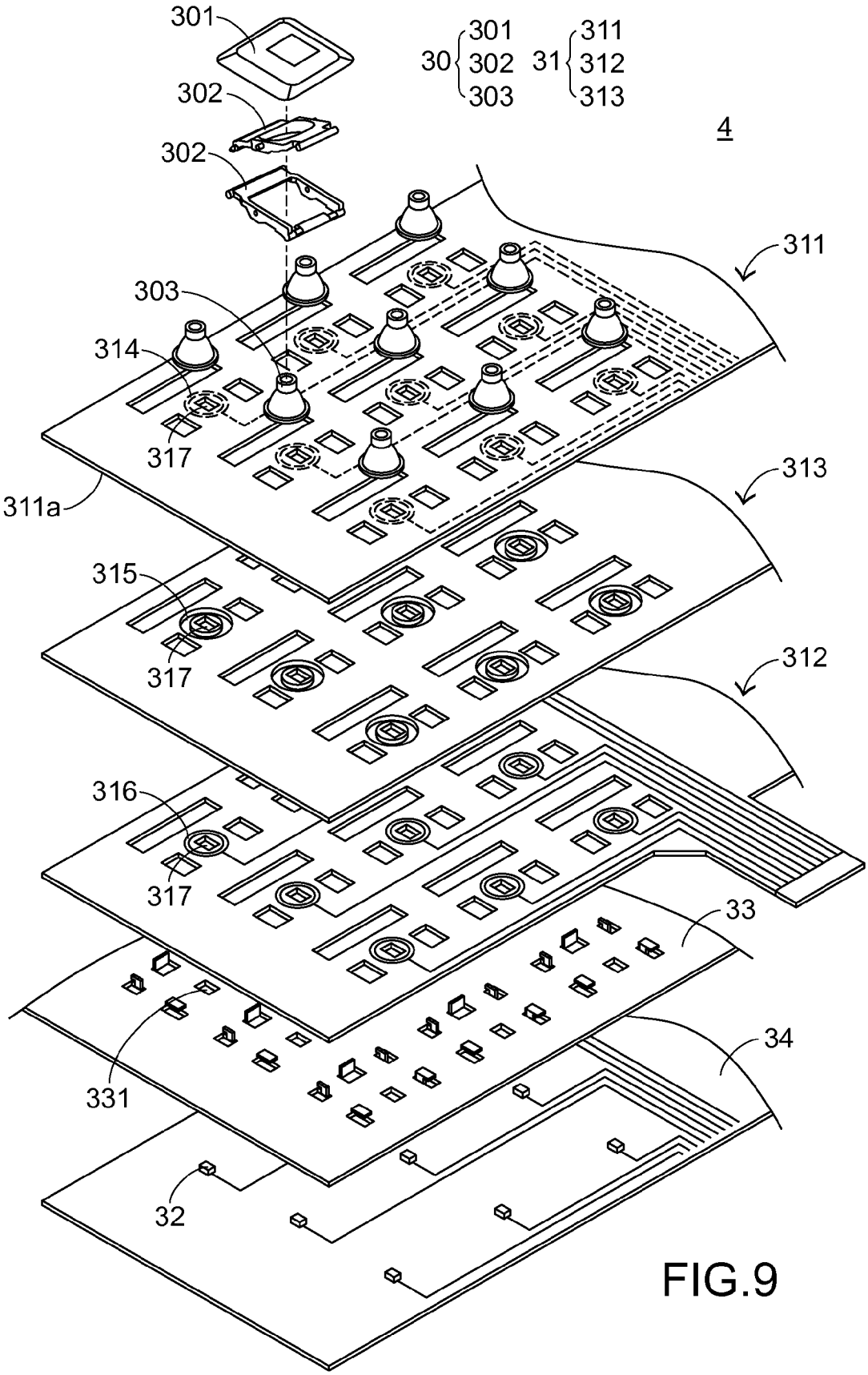
FIG. 9 is a schematic exploded view illustrating the illuminated keyboard device according to a fourth embodiment of the present invention.
Figure 10:
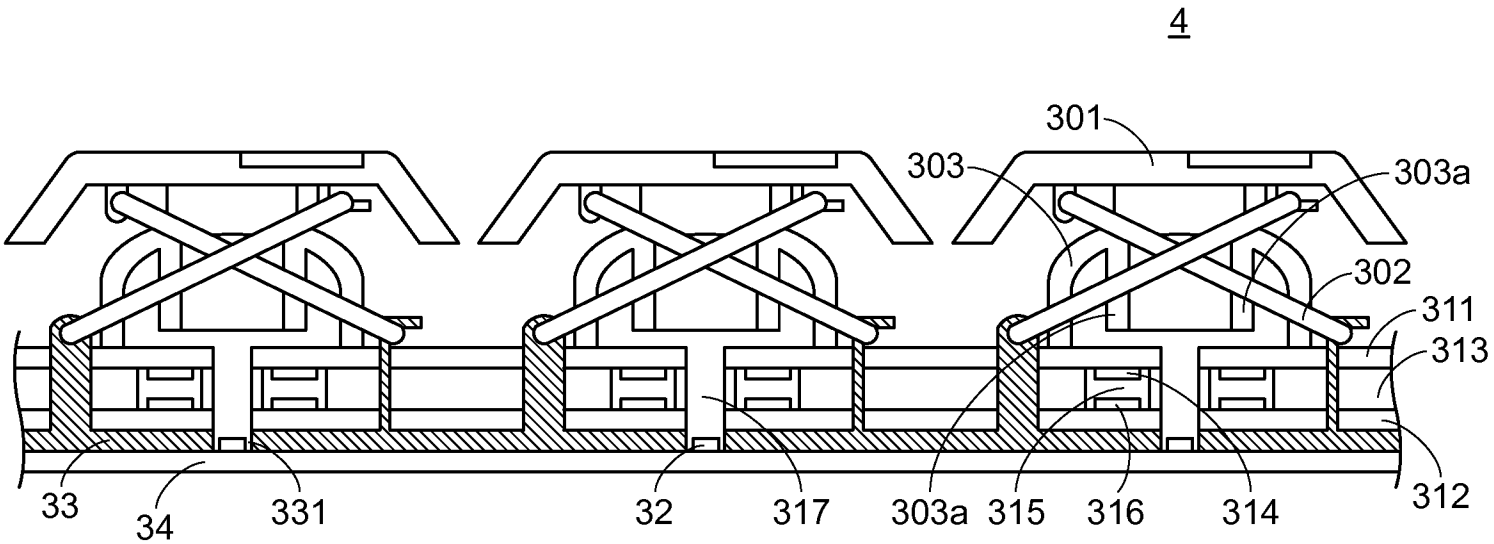
FIG. 10 is a schematic cross-sectional view illustrating the illuminated keyboard device according to the fourth embodiment of the present invention.

Hereinafter, an illuminated keyboard device 4 according to a fourth embodiment of the present invention will be illustrated with reference to FIGS. 9 and 10. FIG. 9 is a schematic exploded view illustrating the illuminated keyboard device according to the fourth embodiment of the present invention. FIG. 10 is a schematic cross-sectional view illustrating the illuminated keyboard device according to the fourth embodiment of the present invention. The illuminated keyboard device 4 comprises plural keys 30, a membrane switch circuit module 31, plural light-emitting elements 32, a supporting plate 33 and an illumination circuit board 34. For clarification and brevity, only one key 30 is shown in FIG. 9.

Each key 30 comprises a keycap 301, a scissors-type connecting element 302 and an elastic element 303. The membrane switch circuit module 31 comprises an upper wiring plate 311, a lower wiring plate 312 and a spacer layer 313. Moreover, plural upper contacts 314 are disposed on a bottom surface 311*a* of the upper wiring plate 311 and connected with each other. In FIG. 9, the plural upper contacts 314 are indicated by dotted lines. The spacer layer 313 is located under the upper wiring plate 311 and comprises plural perforations 315. The lower wiring plate 312 is located under the spacer layer 313 and comprises plural lower contacts 316. The plural lower contacts 316 are connected with each other. Each upper contact 314 is aligned with a corresponding perforation 315 and a corresponding lower contact 316. The upper contact 314, the corresponding perforation 315 and the corresponding lower contact 316 are collectively defined as a key switch for generating a key signal. In this embodiment, all of the upper contacts 314, the perforations 315 and the lower contacts 316 are ring-shaped structures.

In comparison with the first embodiment, the illuminated keyboard device 4 of this embodiment further comprises the illumination circuit board 34. The illumination circuit board 34 is located under the supporting plate 33. Moreover, the plural light-emitting elements 32 are disposed on the illumination circuit board 34 and located under the corresponding keycaps 301. Moreover, the membrane switch circuit module 31 comprises plural openings 317. Each of the plural openings 317 runs through a center region of the corresponding upper contact 314 of the upper wiring plate 311. The supporting plate 33 comprises plural openings 331 in communication with the plural openings 317. The plural light-emitting elements 32 are inserted into the corresponding openings 331 of the supporting plate 33 and exposed to the underlying regions of the corresponding elastic elements 303. Moreover, the light beams from the plural light-emitting elements 32 are transmitted through the plural openings 331 of the supporting plate 33 and the plural openings 317 of the membrane switch circuit module 31 and projected to the corresponding keycaps 301.

As mentioned above, the arrangement of the light-emitting element under the key to directly provide the light beam to the key cannot be effectively applied to the conventional illuminated keyboard device. Obviously, the illuminated keyboard device 4 of the present invention can overcome these drawbacks. In other words, the light utilization efficiency and the luminance uniformity of the illuminated keyboard device 4 are both enhanced.

Figure 11:
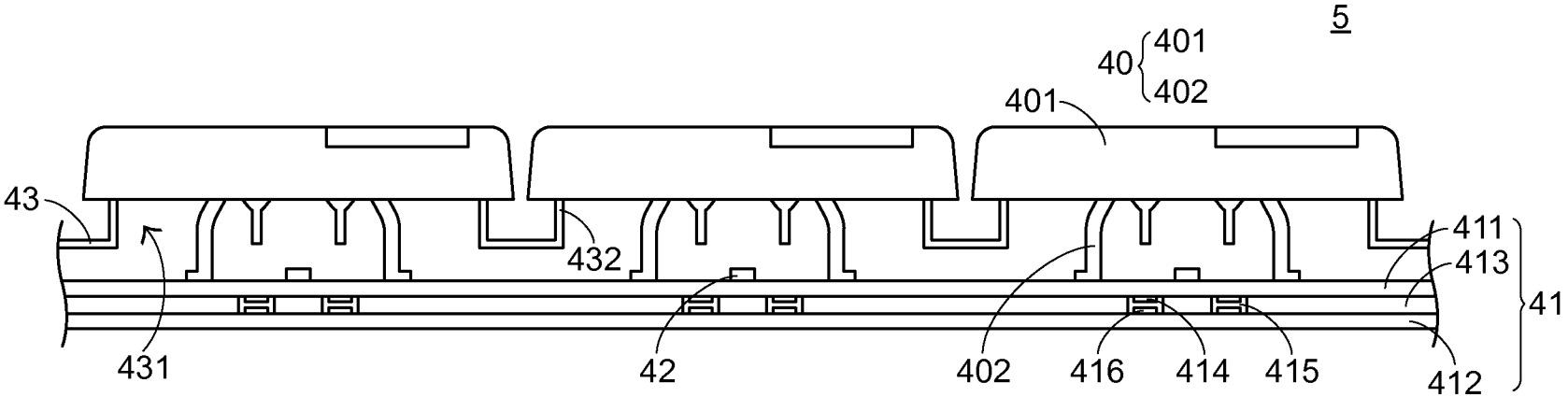
FIG. 11 is a schematic cross-sectional view illustrating the illuminated keyboard device according to a fifth embodiment of the present invention.

Hereinafter, an illuminated keyboard device 5 according to a fifth embodiment of the present invention will be illustrated with reference to FIG. 11. FIG. 11 is a schematic cross-sectional view illustrating the illuminated keyboard device according to the fifth embodiment of the present invention. The illuminated keyboard device 5 comprises plural keys 40, a membrane switch circuit module 41, plural light-emitting elements 42 and a supporting plate 43. The membrane switch circuit module 41 comprises an upper wiring plate 411, a lower wiring plate 412 and a spacer layer 413. The plural light-emitting elements 42 are disposed on a top surface of the upper wiring plate 411 and located under the corresponding keycaps 401.

Moreover, plural upper contacts 414 are disposed on a bottom surface of the upper wiring plate 411, the spacer layer 413 is located under the upper wiring plate 411 and comprises plural perforations 415, and the lower wiring plate 412 is located under the spacer layer 413 and comprises plural lower contacts 416.

In comparison with the first embodiment, each key 40 of the illuminated keyboard device 5 of this embodiment comprises a keycap 401 and an elastic element 402. The supporting plate 43 is arranged between the plural keycaps 401 of the plural keys 40 and the membrane switch circuit module 41. Moreover, the supporting plate 403 comprises plural receiving slots 431. The plural receiving slots 431 are located under the corresponding keycaps 401. The plural elastic elements 402 are disposed on the membrane switch circuit module 41, and disposed within the corresponding receiving slots 431. Moreover, each receiving slot 431 is surrounded by a supporting bulge 432. The plural supporting bulges 432 are locked into the corresponding keycaps 401. Consequently, the plural keycaps 401 are movable upwardly or downwardly relative to the membrane switch circuit module 41. The structure and operating principle of the illuminated keyboard device 5 of this embodiment are similar to those of the illuminated keyboard device 2 of the first embodiment, and are not redundantly described herein.

Figure 12:
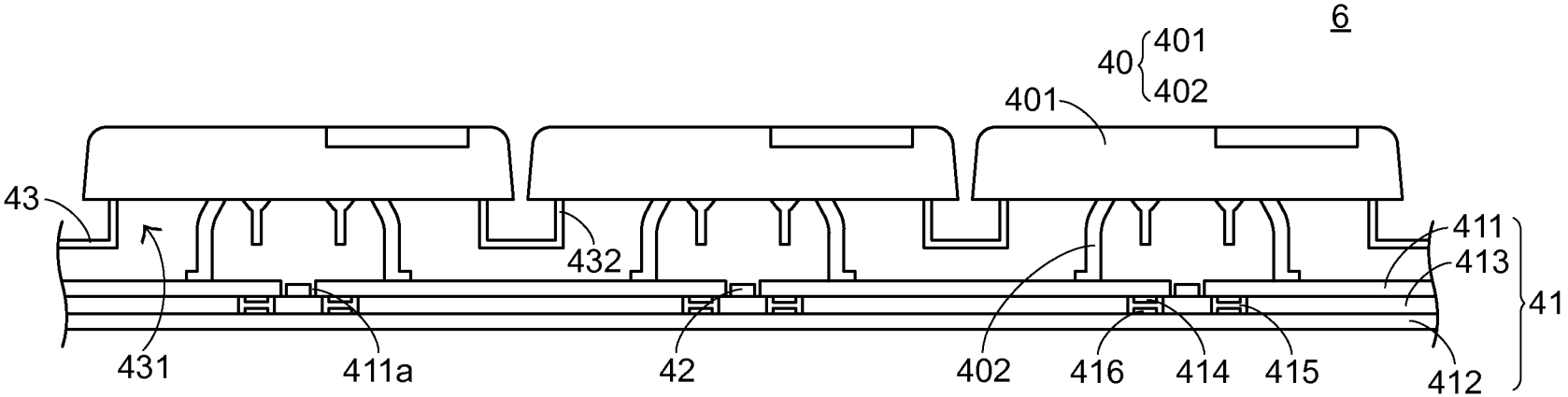
FIG. 12 is a schematic cross-sectional view illustrating the illuminated keyboard device according to a sixth embodiment of the present invention.

Hereinafter, an illuminated keyboard device 6 according to a sixth embodiment of the present invention will be illustrated with reference to FIG. 12. FIG. 12 is a schematic cross-sectional view illustrating the illuminated keyboard device according to the sixth embodiment of the present invention.

In comparison with the fifth embodiment, the upper wiring plate 411 has plural openings 411*a*. Each of the plural 411*a* runs through a center region of the corresponding upper contact 414 of the upper wiring plate 411. The plural light-emitting elements 42 are disposed on a top surface of the spacer layer 413. The plural light-emitting elements 42 are inserted into the corresponding openings 411*a* and exposed to the underlying regions of the corresponding elastic elements 402. The structure and operating principle of the illuminated keyboard device 6 of this embodiment are similar to those of the illuminated keyboard device 5 of the fifth embodiment, and are not redundantly described herein.

Figure 13:
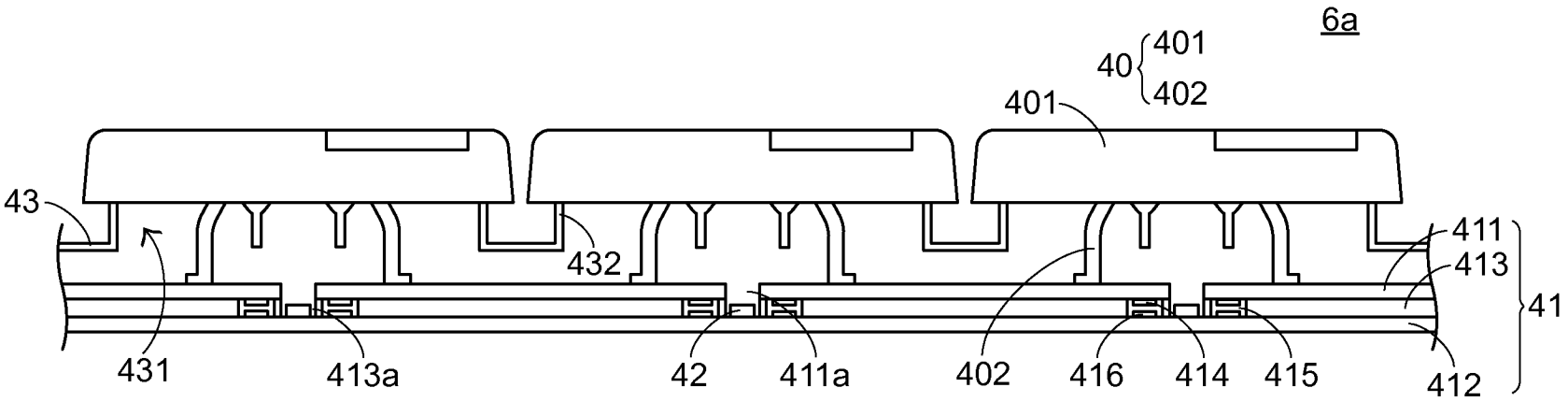
FIG. 13 is a schematic cross-sectional view illustrating the illuminated keyboard device according to a seventh embodiment of the present invention.

Hereinafter, an illuminated keyboard device 6*a* according to a seventh embodiment of the present invention will be illustrated with reference to FIG. 13. FIG. 13 is a schematic cross-sectional view illustrating the illuminated keyboard device according to the seventh embodiment of the present invention.

In comparison with the fifth embodiment, the upper wiring plate 411 of the illuminated keyboard device 6*a* of this embodiment has plural openings 411*c*, and the spacer layer 413 has plural openings 413*a* in communication with the plural openings 411*a*. Each of the plural openings 411*a* runs through a center region of the corresponding upper contact 414 of the upper wiring plate 411. Moreover, the plural light-emitting elements 42 are disposed on a top surface of the lower wiring plate 412. The plural light-emitting elements 42 are inserted into the corresponding openings 413*a* and exposed to the underlying regions of the corresponding elastic elements 402. The structure and operating principle of the illuminated keyboard device 6*a* of this embodiment are similar to those of the illuminated keyboard device 5 of the fifth embodiment, and are not redundantly described herein.

Figure 14:
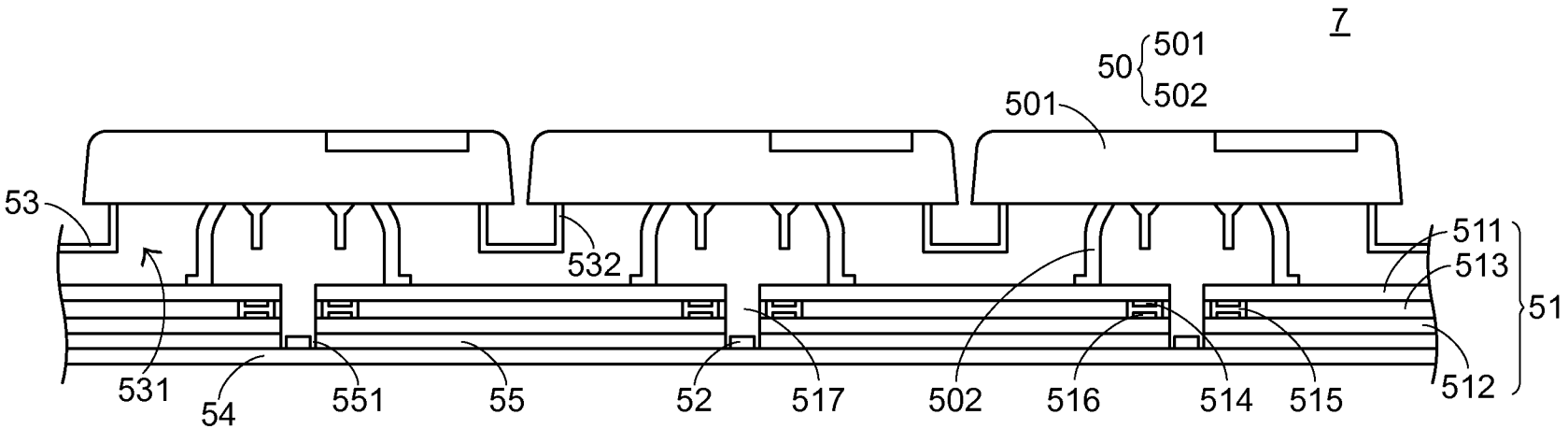
FIG. 14 is a schematic cross-sectional view illustrating the illuminated keyboard device according to an eighth embodiment of the present invention.

Hereinafter, an illuminated keyboard device 7 according to an eighth embodiment of the present invention will be illustrated with reference to FIG. 14. FIG. 14 is a schematic cross-sectional view illustrating the illuminated keyboard device according to the eighth embodiment of the present invention.

The illuminated keyboard device 7 comprises plural keys 50, a membrane switch circuit module 51, plural light-emitting elements 52, a supporting plate 53, an illumination circuit board 54 and a bottom plate 55.

Each key 50 comprises a keycap 501 and an elastic element 502. The membrane switch circuit module 51 comprises an upper wiring plate 511, a lower wiring plate 512 and a spacer layer 513. Moreover, plural upper contacts 514 are disposed on a bottom surface of the upper wiring plate 511, the spacer layer 513 is located under the upper wiring plate 511 and comprises plural perforations 515, and the lower wiring plate 512 is located under the spacer layer 513 and comprises plural lower contacts 516.

In comparison with the fifth embodiment, the illuminated keyboard device 7 of this embodiment further comprises the bottom plate 55 and the illumination circuit board 54. The bottom plate 55 is located under the membrane switch circuit module 51, and the illumination circuit board 54 is located under the bottom plate 55. Moreover, the plural light-emitting elements 52 are disposed on the illumination circuit board 54 and located under the corresponding keycaps 501. Moreover, the membrane switch circuit module 51 comprises plural openings 517. Each of the plural openings 517 runs through a center region of the corresponding upper contact 514 of the upper wiring plate 511. The bottom plate 55 comprises plural openings 551 in communication with the plural openings 517. The plural light-emitting elements 52 are inserted into the corresponding openings 551 of the bottom plate 55 and exposed to the underlying regions of the corresponding elastic elements 502. Moreover, the light beams from the plural light-emitting elements 52 are transmitted through the plural openings 551 of the bottom plate 55 and the plural openings 517 of the membrane switch circuit module 51 and projected to the corresponding keycaps 501. The structure and operating principle of the illuminated keyboard device 7 of this embodiment are similar to those of the illuminated keyboard device 5 of the fifth embodiment, and are not redundantly described herein.

In the first, third, fourth, fifth, seventh or eighth embodiment, the spacer layer is an insulation film or an insulation ink layer. Moreover, since the plural light-emitting elements and the plural light source wiring lines are formed on the top surface of the spacer layer in the second or sixth embodiment, the spacer layer is a physical structure (e.g., an insulation film). In case that the spacer layer is the physical structure (e.g., the insulation film), the plural ring-shaped perforations can be directly formed in the spacer layer. Alternatively, after plural through-holes are formed in the spacer layer, the center regions of the plural through-holes are coated with an insulation ink layer, so that the plural ring-shaped perforations are formed.

From the above descriptions, the present invention provides the illuminated keyboard device. The light-emitting elements are directly located under the corresponding keys. Consequently, the light beams from the light-emitting elements are directly transmitted through the elastic elements are projected to the keys. Under this circumstance, the light utilization efficiency is effectively enhanced. Moreover, the protrusion within the elastic element and the upper contact and the lower contact of the membrane switch circuit module are all ring-shaped structures, and each light-emitting element is aligned with the center region of the corresponding upper contact of the membrane switch circuit module. Consequently, while the keycap is moved downwardly to compress the elastic element, the protrusion can be smoothly moved downwardly to push the membrane switch circuit module without being obstructed by the light-emitting element. Under this circumstance, the upper contact and the corresponding lower contact are contacted with each other to generate the key signal. As mentioned above, the arrangement of the light-emitting element under the key to directly provide the light beam to the key cannot be effectively applied to the conventional illuminated keyboard device. Obviously, the illuminated keyboard device of the present invention can overcome these drawbacks. In other words, the illuminated keyboard device of the present invention has industrial values.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard device, comprising:

plural keys comprising plural keycaps and plural elastic elements, wherein the elastic elements are located under the keycaps, and each of the plural keycaps comprises at least one light outputting zone;

plural light-emitting elements located under the plural elastic elements, and emitting plural light beams to the at least one light outputting zone; and a membrane switch circuit module located under the plural keys, wherein the plural elastic elements are disposed on the membrane switch circuit module, and the membrane switch circuit module comprises:

an upper wiring plate comprising plural upper contacts, wherein each of the plural upper contacts is located under a corresponding elastic element;

a lower wiring plate located under the upper wiring plate, and comprising plural lower contacts corresponding to the plural upper contacts; and a spacer layer arranged between the upper wiring plate and the lower wiring plate, wherein the plural upper contacts and the plural lower contacts are separated from each other by the spacer layer, wherein the spacer layer comprises plural perforations corresponding to the plural upper contacts, wherein each elastic element has a hollow protrusion, and the protrusion is disposed within the elastic element and located over a corresponding upper contact, wherein when one of the plural keycaps is depressed, the membrane switch circuit module is pressed by the protrusion, so that the corresponding upper contact and a corresponding lower contact are contacted with each other to generate a corresponding key signal, and wherein the upper contacts, the protrusions, the lower contacts and the perforations are aligned ring-shaped structures, each having a center region, and wherein the light-emitting elements are is located over each center region of the upper contacts to directly provide light to the keycaps through the hollow protrusions.

2. The illuminated keyboard device according to claim 1, wherein the plural light-emitting elements are disposed on a top surface of the upper wiring plate.

3. The illuminated keyboard device according to claim 2, further comprising plural light source wiring lines, wherein the plural light source wiring lines are formed on the top surface of the upper wiring plate, and the plural light-emitting elements are connected with each other through the plural light source wiring lines.

4. The illuminated keyboard device according to claim 1, further comprising an illumination circuit board, wherein the illumination circuit board is located under the membrane switch circuit module, and the plural light-emitting elements are disposed on the illumination circuit board.

5. The illuminated keyboard device according to claim 4, further comprising a bottom plate, wherein the bottom plate is arranged between the membrane switch circuit module and the illumination circuit board.

6. The illuminated keyboard device according to claim 1, wherein when the membrane switch circuit module is pressed, the corresponding upper contact is inserted into a corresponding perforation and contacted with the corresponding lower contact, so that the corresponding key signal is generated.

7. The illuminated keyboard device according to claim 1, wherein the spacer layer is an insulation film or an insulation ink layer.

8. The illuminated keyboard device according to claim 1, wherein the plural keys further comprise plural scissors-type connecting elements, wherein each of the plural scissors-type connecting elements is arranged between a corresponding keycap and the membrane switch circuit module and connected with the corresponding keycap, wherein the corresponding keycap is movable upwardly or downwardly relative to the membrane switch circuit module through a corresponding scissors-type connecting element.

9. The illuminated keyboard device according to claim 8, further comprising a supporting plate, wherein the supporting plate is located under the membrane switch circuit module and comprises plural supporting bulges, wherein the plural supporting bulges are penetrated through the membrane switch circuit module and connected with the plural scissors-type connecting elements, so that the plural scissors-type connecting elements are fixed on the supporting plate.

10. The illuminated keyboard device according to claim 1, further comprising a supporting plate, wherein the supporting plate is arranged between the plural keycaps and the membrane switch circuit module, and comprises plural receiving slots, wherein the plural receiving slots are located under the keycaps, and the plural elastic elements are disposed within the receiving slots.

11. The illuminated keyboard device according to claim 10, wherein the supporting plate further comprises plural supporting bulges, wherein the plural supporting bulges are located under the keycaps, so that the plural keycaps are supported by the supporting plate.

* * * * *